US008936516B2

(12) United States Patent
Yashiki

(10) Patent No.: US 8,936,516 B2
(45) Date of Patent: Jan. 20, 2015

(54) GOLF CLUB SHAFT

(71) Applicant: Dunlop Sports Co. Ltd., Kobe-shi, Hyogo (JP)

(72) Inventor: Tatsuya Yashiki, Kobe (JP)

(73) Assignee: Dunlop Sports Co., Ltd., Kobe (JP)

( * ) Notice: Subject to any disclaimer, the term of this patent is extended or adjusted under 35 U.S.C. 154(b) by 115 days.

(21) Appl. No.: 13/718,517

(22) Filed: Dec. 18, 2012

(65) Prior Publication Data

US 2013/0172097 A1 Jul. 4, 2013

(30) Foreign Application Priority Data

Dec. 29, 2011 (JP) ..... 2011-290397

(51) Int. Cl.
*A63B 53/10* (2006.01)

(52) U.S. Cl.
USPC ..... 473/319

(58) Field of Classification Search
USPC ..... 473/319
See application file for complete search history.

(56) References Cited

U.S. PATENT DOCUMENTS

| | | | | |
|---|---|---|---|---|
| 1,968,616 | A * | 7/1934 | Oldham | 473/298 |
| 4,319,750 | A * | 3/1982 | Roy | 473/320 |
| 5,538,769 | A * | 7/1996 | Sandman, Jr. | 428/36.3 |
| 5,626,529 | A * | 5/1997 | Roy | 473/319 |
| 5,904,627 | A * | 5/1999 | Miyaji et al. | 473/319 |
| 6,270,426 | B1 * | 8/2001 | Matsumoto | 473/319 |
| 6,602,148 | B2 * | 8/2003 | Hsu | 473/319 |
| 7,918,746 | B2 * | 4/2011 | Kumamoto | 473/319 |

FOREIGN PATENT DOCUMENTS

JP 2007-135811 A 6/2007

* cited by examiner

*Primary Examiner* — Stephen L. Blau
(74) *Attorney, Agent, or Firm* — Birch, Stewart, Kolasch & Birch, LLP

(57) ABSTRACT

A section where the tip side partial bias layer exists in an axis direction of the shaft is defined as a section T; a section where the back end side partial bias layer exists in the axis direction of the shaft is defined as a section B; and a shaft section inserted into a hosel of a head in the axis direction of the shaft is defined as a section H. A part of the section T overlaps with the section H. An overlapping section TB in which the section T overlaps with the section B exists. The whole overlapping section TB is located on a back end Bt side of the shaft from the section H. A center position Px of the overlapping section TB is located on a tip side of the shaft from a center position Pc of the shaft.

20 Claims, 8 Drawing Sheets

GOLF CLUB SHAFT

The present application claims priority on Patent Application No. 2011-290397 filed in JAPAN on Dec. 29, 2011, the entire contents of which are hereby incorporated by reference.

BACKGROUND OF THE INVENTION

1. Field of the Invention

The present invention relates to a golf club shaft.

2. Description of the Related Art

A so-called carbon shaft has been widely used. In the carbon shaft, CFRP (carbon fiber reinforced plastic) is normally used. The fiber reinforced resin has an excellent specific strength and specific rigidity. The carbon shaft can contribute to the weight saving of a club. The weight saving of the club can contribute to the increase of a flight distance.

A bias layer is normally provided in the carbon shaft. The bias layer can enhance torsional rigidity. The directional stability of a hit ball can be improved by the improvement of the torsional rigidity.

A torsional rigidity distribution is specified in Japanese Patent Application Laid-Open No. 2007-135811. A bias prepreg disposed on a tip side and a bias prepreg disposed on a back end side are described in FIG. 6 of the gazette. The bias prepregs have different characteristics. A tip side bias prepreg having a tensile elastic modulus of 40 t/mm$^2$ and a fiber weight basis amount (fiber weight per unit prepreg area) of 100 g/m$^2$ and a back end side bias prepreg having a tensile elastic modulus of 30 t/mm$^2$ and a fiber weight basis amount of 75 g/m$^2$ are described in Paragraph [0052] of the gazette.

SUMMARY OF THE INVENTION

When the tensile elastic modulus is high and the fiber weight basis amount (fiber weight per unit prepreg area) is increased in the tip side bias prepreg, the torsional rigidity in a tip part of the shaft is apt to become excessive. In this case, shock at impact is increased, which is apt to worsen ball hitting feeling.

On the other hand, a club balance (swing weight) is considered in a golf club. It is known that it become easy to swing the golf club by adjusting the golf club to a proper club balance. The club balance is adjusted by a head weight or the like. When a center of gravity of a shaft is brought close to a back end, the head weight is made heavy in order to obtain a proper club balance. However, the excessive head weight may increase toe down. The position or posture of the head at impact may be fluctuated by the toe down. The toe down may reduce the probability for a nice shot.

It is an object of the present invention to provide a golf club shaft which can attain excellent ball-hitting feeling and a position of a center of gravity close to a tip.

A golf club shaft according to the present invention includes a straight layer; a tip side partial bias layer; and a back end side partial bias layer. When a section where the tip side partial bias layer exists in an axis direction of the shaft is defined as a section T; a section where the back end side partial bias layer exists in the axis direction of the shaft is defined as a section B; and a shaft section inserted into a hosel of a head in the axis direction of the shaft is defined as a section H, a part of the section T overlaps with the section H. An overlapping section TB in which the section T overlaps with the section B exists in the shaft. The whole overlapping section TB is located on a back end side of the shaft from the section H. A center position Px in the axis direction of the overlapping section TB is located on a tip side of the shaft from a center position Pc in the axis direction of the shaft.

Preferably, at least a part of the overlapping section TB exists in a section separated by 40 mm or greater and 200 mm or less from a tip end of the shaft.

Preferably, a tip of the back end side partial bias layer is located in a section separated by 40 mm or greater and 190 mm or less from a tip end of the shaft.

Preferably, a torsional rigidity distribution has a local maximum value in the overlapping section TB.

When a back end width of the back end side partial bias layer is defined as w1, and a tip width of the back end side partial bias layer is defined as w2, w2/w1 is preferably greater than 1.

Preferably, a width wb of the back end side partial bias layer is increased toward the tip side of the shaft from the back end side of the shaft.

Preferably, a prepreg weight basis amount (prepreg weight per unit prepreg area) of the tip side partial bias layer is less than that of the back end side partial bias layer.

When a section between a tip end of the shaft and a position separated by 80 mm from the tip end of the shaft is defined as a specific tip part, preferably, a mass ratio Rs of the straight layer in the specific tip part is 33% or greater and 45% or less. More preferably, the ratio Rs is 40% or greater and 42% or less.

A golf club according to the present invention includes any one of the above shafts, a head, and a grip.

The present invention can attain excellent ball-hitting feeling and a position of a center of gravity close to a tip.

DESCRIPTION OF THE PREFERRED EMBODIMENTS

Figure 1:
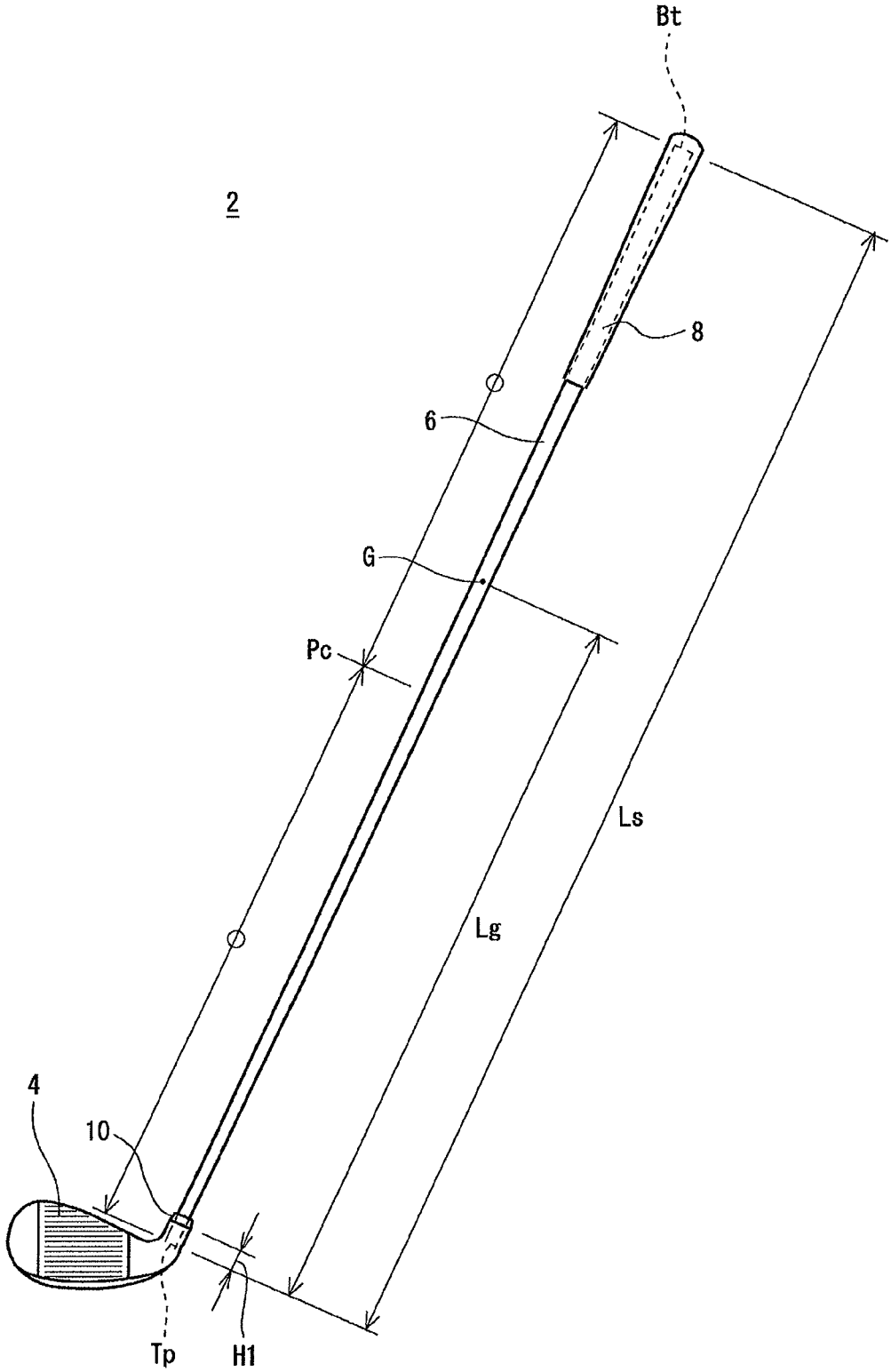
FIG. 1 shows a golf club including a shaft according to a first embodiment of the present invention.

Hereinafter, the present invention will be described in detail based on the preferred embodiments with appropriate references to the accompanying drawings.

The term "layer" and the term "sheet" are used in the present application. The "layer" is termed after being wound. On the other hand, the "sheet" is termed before being wound. The "layer" is formed by winding the "sheet". That is, the wound "sheet" forms the "layer". In the present application, the same reference numeral is used in the layer and the sheet. For example, a layer formed by a sheet s1 is defined as a layer s1.

In the present application, an "inside" means an inside in a radial direction of a shaft. In the present application, an "outside" means an outside in the radial direction of the shaft.

In the present application, an "axis direction" means an axis direction of the shaft.

In the present application, an angle Af and an absolute angle θa are used for the angle of a fiber to the axis direction. The angle Af is a plus or minus angle. The absolute angle θa is the absolute value of the angle Af. In other words, the absolute angle θa is the absolute value of an angle between the axis direction and the direction of the fiber. For example, "the absolute angle θa is equal to or less than 10 degrees" means that "the angle Af is −10 degrees or greater and +10 degrees or less".

FIG. 1 shows a golf club 2 including a golf club shaft 6 according to a first embodiment of the present invention. The golf club 2 includes a head 4, a shaft 6, a grip 8, and a ferrule 10. The head 4 is provided in the tip part of the shaft 6. The grip 8 is provided in the back end part of the shaft 6. The head 4 and the grip 8 are not limited. Examples of the head 4 include a wood type golf club head, a hybrid type golf club head, a utility type golf club head, an iron type golf club head, and a putter head. The head 4 of the embodiment is the iron type golf club head. The material of the head 4 is not limited. Examples of the material of the head 4 include titanium, a titanium alloy, CFRP (carbon fiber reinforced plastic), stainless steel, maraging steel, and soft iron. A plurality of materials can be also combined.

The shaft 6 includes a laminate including fiber-reinforced resin layers. The shaft 6 is a tubular body. The shaft 6 has a hollow structure. As shown in FIG. 1, the shaft 6 has a tip Tp and a back end Bt. The tip Tp is located in the head 4. The back end Bt is located in the grip 8.

The shaft 6 is a so-called carbon shaft. The shaft 6 is produced by curing a prepreg sheet. In a typical prepreg sheet, a fiber is oriented substantially in one direction. Thus, the prepreg in which the fiber is oriented substantially in one direction is also referred to as a UD prepreg. The term "UD" stands for uni-direction. Prepregs other than the UD prepreg may be used. For example, fibers contained in the prepreg sheet may be woven.

The prepreg sheet has a fiber and a resin. The resin is also referred to as a matrix resin. The fiber is typically a carbon fiber. The matrix resin is typically a thermosetting resin.

The shaft 6 is manufactured by a so-called sheet winding method. In the prepreg, the matrix resin is in a semicured state. The shaft 6 is obtained by winding and curing the prepreg sheet. The curing means the curing of the semicured matrix resin. The curing is attained by heating. The manufacturing process of the shaft 6 includes a heating process. The heating process cures the matrix resin of the prepreg sheet.

Figure 2:
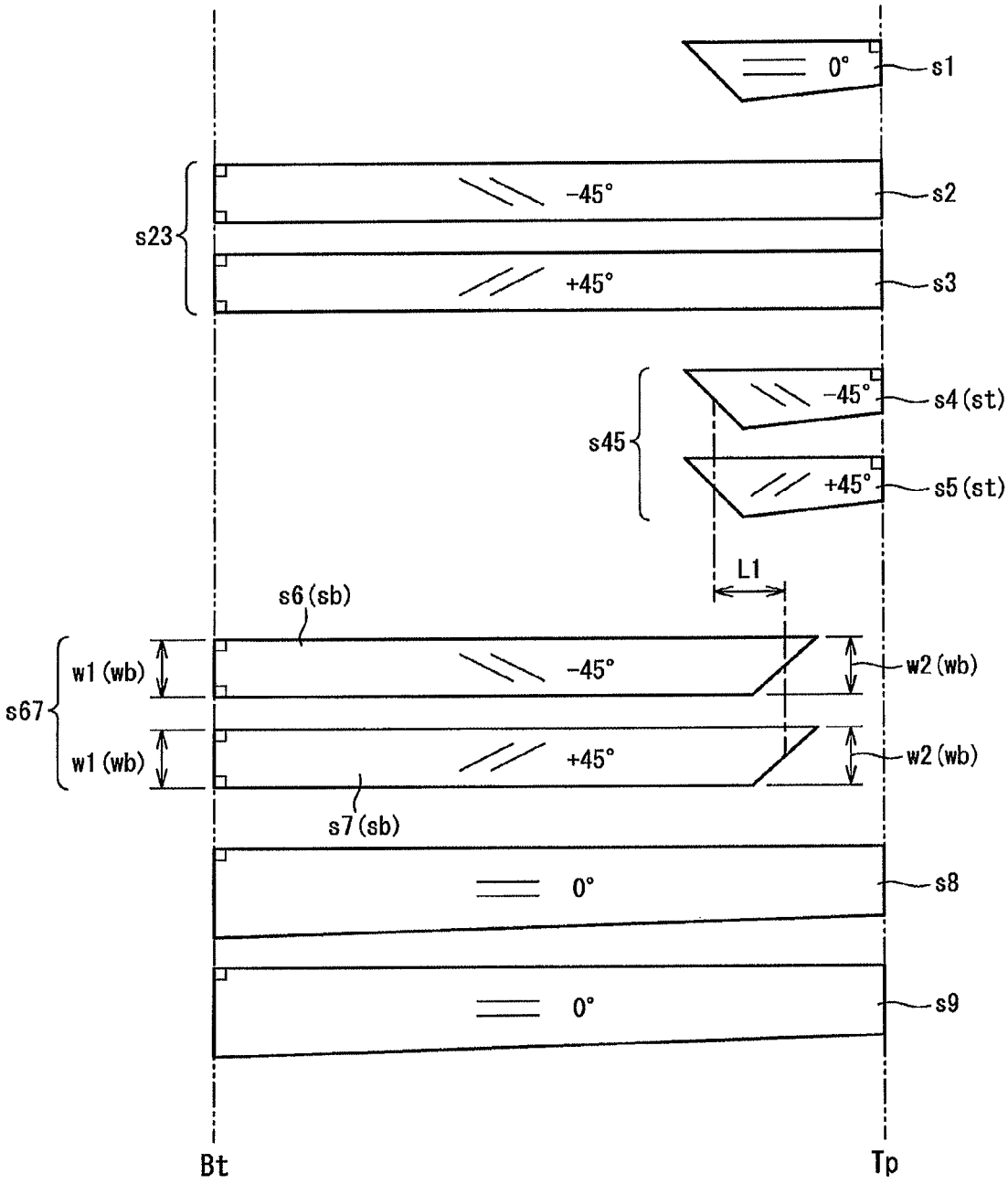
FIG. 2 is a developed view of the shaft according to the first embodiment.

FIG. 2 is a developed view (sheet constitution view) of the prepreg sheets constituting the shaft 6. The shaft 6 includes a plurality of sheets. In the embodiment of FIG. 2, the shaft 6 includes nine sheets s1 to s9. In the present application, the developed view shown in FIG. 2 or the like shows a winding order. The sheets are wound in order from the sheet located on the uppermost side in the developed view. The sheet wound first is a first sheet s1. Next, a second sheet s2 and a third sheet s3 are wound. Next, a fourth sheet s4 and a fifth sheet s5 are wound. Next, a sixth sheet s6 and a seventh sheet s7 are wound. Next, an eighth sheet s8 is wound. Next, a ninth sheet s9 is wound. The previously wound sheet is located inside.

In the developed view of the present application, the horizontal direction of the figure coincides with the axis direction of the shaft. In the developed view of the present application, the right side of the figure is a tip side of the shaft, and the left side of the figure is a back end side of the shaft.

The developed view of the present application shows not only the winding order of each of the sheets but also the disposal of each of the sheets in the axis direction of the shaft. For example, in FIG. 2, the tip of the sheet s1 is located at the tip Tp of the shaft. For example, in FIG. 2, the back end of the sheet s6 is located at the back end Bt of the shaft.

The shaft 6 has a straight layer and a bias layer. The orientation angle Af of each sheet is described in the developed view of the present application. A sheet described as "0 degree" constitutes the straight layer. The sheet for the straight layer is also referred to as a straight sheet in the present application.

The straight layer is a layer in which the orientation angle Af is substantially 0 degree to the axis direction of the shaft. Usually, the orientation angle Af may not be completely set to 0 degree to the axis direction of the shaft by error or the like in winding. Usually, in the straight layer, the orientation angle Af is −10 degrees or greater and +10 degrees or less. That is, usually, in the straight layer, the absolute angle θa is equal to or less than 10 degrees.

In the embodiment of FIG. 2, the straight sheets are the sheet s1, the sheet s8, and the sheet s9. The straight layer is highly correlated with the flexural rigidity and flexural strength of the shaft.

On the other hand, the bias layer is highly correlated with the torsional rigidity and torsional strength of the shaft. Preferably, the bias layer includes a two-sheet pair in which fibers are inclined in opposite directions to each other. In respect of enhancing the torsional rigidity, the absolute angle θa of the bias layer is preferably equal to or greater than 15 degrees, more preferably equal to or greater than 25 degrees, and still more preferably equal to or greater than 40 degrees. In respect of enhancing the torsional rigidity, the absolute angle θa of the bias layer is preferably equal to or less than 60 degrees, and more preferably equal to or less than 50 degrees. Typically, the absolute angle θa of the bias layer is set to 45 degrees. In the embodiment, the absolute angle θa is 45 degrees. However, an error of about ±10 degree can be allowed.

In the shaft 6, the sheets constituting the bias layer are the sheet s2, the sheet s3, the sheet s4, the sheet s5, the sheet s6, and the sheet s7. In FIG. 2, the angle Af is described in each sheet. The plus (+) and minus (−) in the angle Af show that the fibers of bias sheets are inclined in opposite directions to each other. In the present application, the sheet for the bias layer is also merely referred to as a bias sheet.

In the embodiment of FIG. 2, the angle of the sheet s2 is −45 degrees and the angle of the sheet s3 is +45 degrees. However, conversely, it should be appreciated that the angle of the sheet s2 may be +45 degrees and the angle of the sheet s3 may be −45 degrees.

The shaft 6 may have a hoop layer although the hoop layer is not employed in the embodiment of FIG. 2. Preferably, the absolute angle θa in the hoop layer is substantially 90 degrees. However, the orientation direction of the fiber to the axis direction of the shaft may not be completely set to 90 degrees by an error or the like in winding. Usually, in the hoop layer, the absolute angle θa is 80 degrees or greater and 90 degrees or less.

Although not shown in the drawings, the prepreg sheet before being used is sandwiched between cover sheets. The cover sheets are usually a mold release paper and a resin film. That is, the prepreg sheet before being used is sandwiched between the mold release paper and the resin film. The mold release paper is applied to one surface of the prepreg sheet, and the resin film is applied to the other surface of the prepreg sheet. Hereinafter, the surface to which the mold release paper is applied is also referred to as "a surface of a mold release paper side", and the surface to which the resin film is applied is also referred to as "a surface of a film side".

In order to wind the prepreg sheet, the resin film is previously peeled. The surface of the film side is exposed by peeling the resin film. The exposed surface has tacking property (tackiness). The tacking property is caused by the matrix resin. That is, since the matrix resin is in a semicured state, the tackiness is developed. Next, the edge part of the exposed surface of the film side (also referred to as a winding start edge part) is applied to a wound object. The winding start edge part can be smoothly applied by the tackiness of the matrix resin. The wound object is a mandrel or a wound article obtained by winding the other prepreg sheet around the mandrel. Next, the mold release paper is peeled. Next, the wound object is rotated to wind the prepreg sheet around the wound object. Thus, the resin film is previously peeled. Next, the winding start edge part is applied to the wound object, and the mold release paper is then peeled. That is, the resin film is previously peeled. After the winding start edge part is applied to the wound object, the mold release paper is peeled. The procedure suppresses wrinkles and winding fault of the sheet. This is because the sheet to which the mold release paper is applied is supported by the mold release paper, and hardly causes wrinkles. The mold release paper has flexural rigidity higher than that of the resin film.

In the embodiment of FIG. 2, all the bias sheets are used in pairs. Preferably, two bias sheets constituting the bias sheet pair are bonded before winding.

In the embodiment of FIG. 2, three bias sheet pairs are used. A first bias sheet pair s23 includes the sheet s2 and the sheet s3. A second bias sheet pair s45 includes the sheet s4 and the sheet s5. A third bias sheet pair s67 includes the sheet s6 and the sheet s7. In the embodiment, layers other than the bias layer are not interposed among the three bias layer pairs.

Preferably, the circumferential position of the sheet s2 is different from that of the sheet s3. The difference is a half circle (180 degrees±10 degrees), for example. The difference can be attained by deviating the sheets from each other in bonding. Similarly, preferably, the circumferential position of the sheet s4 is different from that of the sheet s5. Similarly, preferably, the circumferential position of the sheet s6 is different from that of the sheet s7. A level difference caused by the thickness of the sheet can be dispersed in the circumferential direction by the difference of the circumferential positions.

As described above, in the present application, the sheet and the layer are classified by the orientation angle of the fiber. Furthermore, in the present application, the sheet and the layer are classified by the length of the axis direction of the shaft.

In the present application, a layer disposed all over in the axis direction of the shaft is referred to as a full length layer. In the present application, a sheet disposed all over in the axis direction of the shaft is referred to as a full length sheet. The wound full length sheet forms the full length layer.

On the other hand, in the present application, a layer partially disposed in the axis direction of the shaft is referred to as a partial layer. In the present application, a sheet partially disposed in the axis direction of the shaft is referred to as a partial sheet. The wound partial sheet forms the partial layer.

In the present application, the full length layer which is the straight layer is also referred to a full length straight layer. In the embodiment of FIG. 2, the full length straight layers are a layer s8 and a layer s9. In the embodiment, all the full length straight layers are located outside the outermost bias layer pair.

In the present application, the partial layer which is the straight layer is also referred to a partial straight layer. In the embodiment of FIG. 2, the partial straight layers is a layer s1.

In the present application, the full length layer which is the bias layer is also referred to as a full length bias layer. In the embodiment of FIG. 2, the full length bias layers are a layer s2 and a layer s3.

In the present application, the bias layer pair which is the full length layer is also referred to as a full length bias layer pair. In the embodiment of FIG. 2, the full length bias layer pair is a layer s23.

In the present application, the bias layer pair which is the partial layer is also referred to as a partial bias layer pair. In the embodiment of FIG. 2, the partial bias layer pair are a layer s45 and a layer S67.

The term "tip side partial layer" is used in the present application. The tip side partial layer is one aspect of the partial layer. Examples of the tip side partial layer include a tip side partial straight layer and a tip side partial bias layer. In the embodiment of FIG. 2, the tip side partial straight layer is a layer s1. In the embodiment of FIG. 2, the tip side partial bias layer st is a layer s4 and a layer s5.

The term "back end side partial layer" is used in the present application. The back end side partial layer is one aspect of the partial layer. Examples of the back end side partial layer include a back end side partial straight layer and a back end partial bias layer. In the embodiment of FIG. 2, the backend side partial straight layer does not exist. In the embodiment of FIG. 2, the back end side partial bias layer sb is a layer s6 and a layer s7.

In the embodiment, the shaft 6 is produced by the sheet winding method using the sheets shown in FIG. 2.

Hereinafter, a manufacturing process of the shaft 6 will be schematically described.

[Outline of Manufacturing Process of Shaft]

(1) Cutting Process

The prepreg sheet is cut into a desired shape in the cutting process. Each of the sheets shown in FIG. 2 is cut out by the process.

The cutting may be performed by a cutting machine, or may be manually performed. In the manual case, for example, a cutter knife is used.

(2) Stacking Process (Bonding Process)

A plurality of sheets is stacked in the stacking process. In the embodiment, the sheet s2 and sheet s3 are stuck; the sheet s4 and the sheet s5 are stuck; and the sheet s6 and the sheet s7 are stuck. Thus, the sheets constituting the bias layer pair are stuck in the embodiment.

In the stacking process, heating or a press may be used. More preferably, the heating and the press are used in combination. In a winding process to be described later, the deviation of the sheet may be produced during the winding operation of the bias sheet pair. The deviation reduces winding accuracy. The heating and the press improve an adhesive force between the sheets. The heating and the press suppress the deviation between the sheets in the winding process.

In respect of enhancing the adhesive force between the sheets, a heating temperature in the stacking process is preferably equal to or greater than 30° C., and more preferably equal to or greater than 35° C. When the heating temperature is too high, the curing of the matrix resin may be progressed, to reduce the tackiness of the sheet. The reduction of the tackiness reduces adhesion between the bias sheet pair and the wound object. The reduction of the adhesion may allow the generation of wrinkles, to generate the deviation of a winding position. In this respect, the heating temperature in the stacking process is preferably equal to or less than 60° C., more preferably equal to or less than 50° C., and still more preferably equal to or less than 40° C.

In respect of enhancing the adhesive force between the sheets, a heating time in the stacking process is preferably equal to or greater than 20 seconds, and more preferably equal to or greater than 30 seconds. In respect of maintaining the tackiness of the sheet, the heating time in the stacking process is preferably equal to or less than 300 seconds.

In respect of enhancing the adhesive force between the sheets, a press pressure in the stacking process is preferably equal to or greater than 300 g/cm$^2$, and more preferably equal to or greater than 350 g/cm$^2$. When the press pressure is excessive, the prepreg may be crushed. In this case, the thickness of the prepreg is made thinner than a designed value. In respect of thickness accuracy of the prepreg, the press pressure in the stacking process is preferably equal to or less than 600 g/cm$^2$, and more preferably equal to or less than 500 g/cm$^2$.

In respect of enhancing the adhesive force between the sheets, a press time in the stacking process is preferably equal to or greater than 20 seconds, and more preferably equal to or greater than 30 seconds. In respect of the thickness accuracy of the prepreg, the press time in the stacking process is preferably equal to or less than 300 seconds.

(3) Winding Process

A mandrel is prepared in the winding process. A typical mandrel is made of a metal. A mold release agent is applied to the mandrel. Furthermore, a resin having tackiness is applied to the mandrel. The resin is also referred to as a tacking resin. The cut sheet is wound around the mandrel. The tacking resin facilitates the application of the end part of the sheet to the mandrel.

The sheets for bonding are wound in a state where the sheets are bonded. In the embodiment, the bias sheets are wound in a state of a sheet pair.

A winding body is obtained by the winding process. The winding body is obtained by wrapping the prepreg sheet around the outside of the mandrel. For example, the winding is performed by rolling the wound object on a plane. The winding may be performed by a manual operation or a machine. The machine is referred to as a rolling machine.

(4) Tape Wrapping Process

A tape is wrapped around the outer peripheral surface of the winding body in the tape wrapping process. The tape is also referred to as a wrapping tape. The wrapping tape is wrapped while tension is applied to the wrapping tape. A pressure is applied to the winding body by the wrapping tape. The pressure reduces voids.

(5) Curing Process

In the curing process, the winding body after performing the tape wrapping is heated. The heating cures the matrix resin. In the curing process, the matrix resin fluidizes temporarily. The fluidization of the matrix resin can discharge air between the sheets or in the sheet. The pressure (fastening force) of the wrapping tape accelerates the discharge of the air. The curing provides a cured laminate.

(6) Process of Extracting Mandrel and Process of Removing Wrapping Tape

The process of extracting the mandrel and the process of removing the wrapping tape are performed after the curing process. The process of removing the wrapping tape is preferably performed after the process of extracting the mandrel in respect of improving the efficiency of the process of removing the wrapping tape.

(7) Process of Cutting Both Ends

The both end parts of the cured laminate are cut in the process. The cutting flattens the end face of the tip Tp and the end face of the back end Bt. The developed view of the present application is drawn with a portion cut in the process of cutting the both ends removed for the sake of simplicity. In fact, in the cutting process, a sheet having a size also including the portion cut in the process of cutting both the ends is cut.

(8) Polishing Process

The surface of the cured laminate is polished in the process. Spiral unevenness left behind as the trace of the wrapping tape exists on the surface of the cured laminate. The polishing extinguishes the unevenness as the trace of the wrapping tape to flatten the surface of the cured laminate.

(9) Coating Process

The cured laminate after the polishing process is subjected to coating.

The shaft 6 is obtained in the processes.

Figure 3:
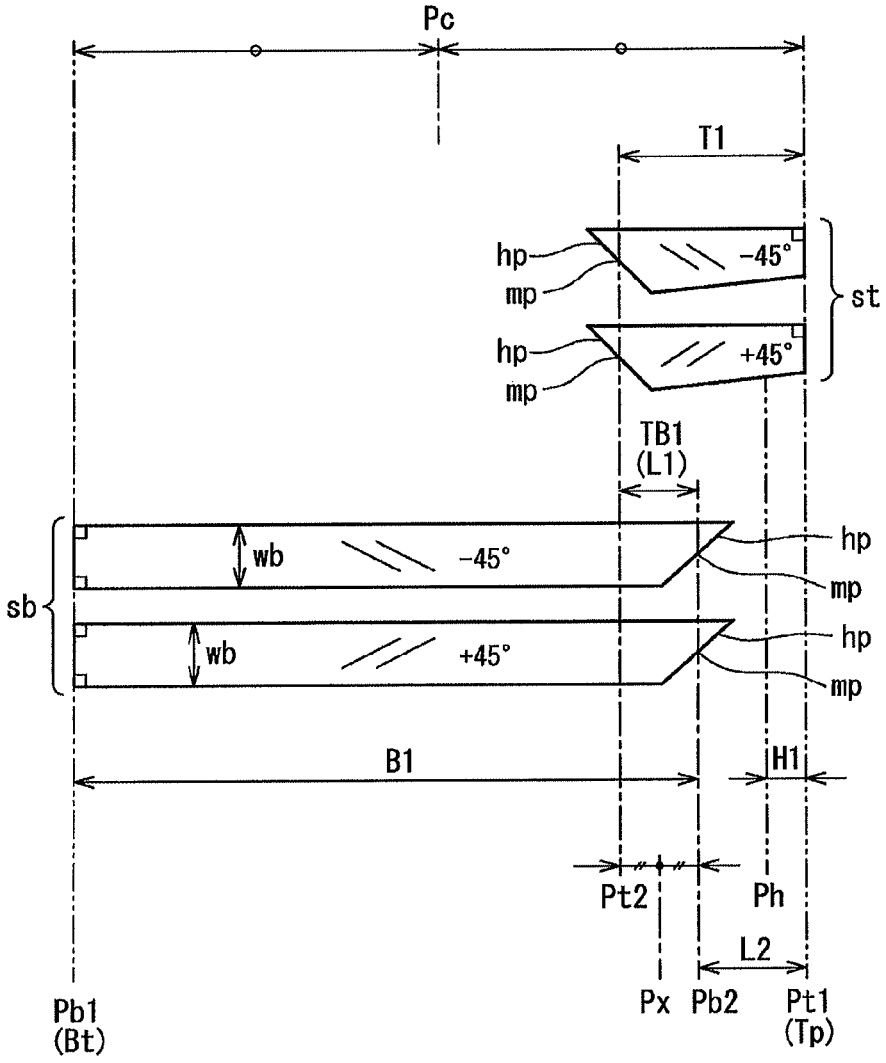
FIG. 3 is a developed view showing a tip side partial bias layer and a back end side partial bias layer in the embodiment of FIG. 2.

FIG. 3 shows sections or the like in the present application in FIG. 2. The following terms are defined in the present application.

[Section T]

A section where the tip side partial bias layer st exists in the axis direction of the shaft is referred to as a section T in the present application. In FIG. 3, the section T is represented by symbol T1.

The section T is a section between a tip Pt1 and a back end position Pt2 of the tip side partial bias layer st. As in the embodiment of FIG. 3, when a sheet end is an oblique side hp, a middle point mp of the oblique side hp is considered to be the sheet end. This is because the position of the middle point mp is considered to be substantially equivalent to the position of the sheet end along the circumferential direction in view of a case where the sheet end is provided along not the oblique side hp but the circumferential direction. Therefore, in the embodiment, the back end position Pt2 of the tip side partial bias layer st is considered to be the middle point mp.

[Section B]

A section where the back end side partial bias layer sb exists in the axis direction of the shaft is referred to as a section B in the present application. In FIG. 3, the section B is represented by symbol B1.

The section B is a section between a back end position Pb1 and a tip position Pb2 of the back end side partial bias layer sb. When the sheet end is the oblique side hp, the middle point mp of the oblique side hp is considered to be the sheet end. This reason is described above. Therefore, in the embodiment, the tip position Pb2 of the back end side partial bias layer sb is considered to be the middle point mp.

[Section H]

A shaft section inserted into the hosel of the head in the axis direction of the shaft is defined as a section H. In FIG. 3, the section H is represented by symbol H1. A position of an end face of the hosel is represented by symbol Ph in FIG. 3.

An axial length of the section H is usually 25 mm or greater and 40 mm or less.

[Section S]

A section between the tip Tp of the shaft and the tip position Pb2 in the axis direction of the shaft is defined as a section S. An axial distance of the section S is L2 (see FIG. 3).

[Overlapping Section TB]

An axial section where the section T and the section B overlap with each other is an overlapping section TB. In FIG. 3, the overlapping section TB is represented by symbol TB1. The overlapping section TB is a section between the tip position Pb2 of the back end side partial bias layer sb and the back end position Pt2 of the tip side partial bias layer st.

In the embodiment, a part of the section T overlaps with the section H. In other words, the tip side partial bias layer st continuously extends from the section H to the back end side of the section H. The tip side partial bias layer st exists on the hosel end face. Moderate torsional rigidity in the tip part of the shaft is secured by the constitution. The moderate torsional rigidity stabilizes a direction of a face surface during a swing, and thereby the directional stability of the hit ball can be improved.

In the embodiment, the whole overlapping section TB is located on the back end Bt side of the shaft from the section H. In other words, the tip (the tip position Pb2 of the back end side partial bias layer sb) of the overlapping section TB is located on the back end Bt side of the shaft from the section H.

The inner diameter of the hosel of the head and the diameter of the tip end of the shaft are preferably set to predetermined values in view of compatibility with the other shaft. The overlapping section TB is located outside the section H, and thereby the outer diameter of the shaft in the section H can be made thin as in the usual shaft. Therefore, the shaft can be inserted into the hosel hole of the usual head, and thereby the versatile shaft is realized.

In the overlapping section TB, the other layer may be interposed between the tip side partial bias layer st and the backend side partial bias layer sb. In the embodiment, in the overlapping section TB, the tip side partial bias layer st and the back end side partial bias layer sb are brought into contact with each other. In other words, the other layer is not interposed between the tip side partial bias layer st and the back end side partial bias layer sb. The bias layers adhere to each other, and thereby the torsional rigidity in the overlapping section TB tends to be further improved.

[Overlapping Length L1]

An axial length of the overlapping section TB (also referred to as an overlapping length) is represented by a double-pointed arrow L1 in FIG. 2. In respect of enhancing an effect for moving a center of gravity by the overlapping section TB, it is not preferable that the overlapping length L1 is too long or too short. In this respect, the overlapping length L1 is preferably equal to or greater than 50 mm as a lower limit, more preferably equal to or greater than 70 mm, and still more preferably equal to or greater than 100 mm. The overlapping length L1 is preferably equal to or less than 300 mm as an upper limit, more preferably equal to or less than 250 mm, and still more preferably equal to or less than 200 mm.

The shaft 6 has a center of gravity G. The center of gravity G is a center of gravity of a shaft simple body. The center of gravity G of the shaft is shown in FIG. 1. A shaft full length is represented by a double-pointed arrow Ls in FIG. 1. A distance between the tip Tp and the center of gravity G of the shaft is represented by a double-pointed arrow Lg in FIG. 1. The shaft full length Ls and the distance Lg are measured along the axis direction.

[Lg/Ls]

Lg/Ls is decreased, and thereby a swing weight can be set to a proper value, and a head weight can be lightened. The weight saving of the head weight can decrease a toe down amount. In respect of suppressing toe down, Lg/Ls is preferably equal to or less than 0.515, and more preferably equal to or less than 0.510.

Usually, the diameter of the tip end of the shaft is roughly decided by the head. The diameter of the tip end of the shaft is usually thinner than that of the back end of the shaft. For this reason, there is a limit to bring the center of gravity G of the shaft close to the tip. Lg/Ls is usually equal to or greater than 0.48 in view of the limit.

[Shaft Full Length Ls]

The shaft full length Ls is not limited. In respect of suppressing the toe down, the shaft full length Ls is preferably shortened. Generally, in a golf club set, importance tends to be particularly placed on the directional stability of the hit ball and ball hitting feeling in a short club. In these respects, the shaft full length Ls is preferably equal to or less than 37 inches, more preferably equal to or less than 36 inches, and still more preferably equal to or less than 35.5 inches. In the usual golf club, the shaft full length Ls is equal to or greater than 33 inches. Except for a putter club, the shaft full length Ls is equal to or greater than 35 inches. Preferred example of iron number is a so-called wedge. As preferred example of the club, a real loft angle is 45 degrees greater and 70 degrees or less. Of course, in view of also a flight distance, the present invention is effective also in a club having a long shaft full length Ls.

Lg/Ls is easily adjusted by the tip side partial bias layer and the back end side partial bias layer. Lg/Ls is easily adjusted by the existence of the overlapping section TB.

In the embodiment, a center position Px of the overlapping section TB in the axis direction is located on a tip side from a center position Pc in the axis direction of the shaft (see FIG. 3). The center of gravity G of the shaft tends to be brought close to the tip Tp of the shaft by the constitution. In other words, Lg/Ls tends to be decreased by the constitution. Therefore, the head can be lightened while a proper swing weight can be maintained, and the toe down can be suppressed. The stability of the result of the hit ball can be improved by suppressing the toe down. That is, the suppression of the toe down improves a meeting rate (the probability for a nice shot), and improves the directional stability of the hit ball. Furthermore, the improvement in the meeting rate can increase the flight distance.

The overlapping section TB is disposed near the hosel, and thereby low torsional rigidity in the section S can be effectively complemented.

In respects of the suppression of the toe down and of the directional stability, a distance L2 between the tip Tp of the shaft and the tip position Pb2 in the axis direction is preferably equal to or less than 190 mm, more preferably equal to or less than 160 mm, and still more preferably equal to or less than 140 mm. In respect of avoiding the overlap of the overlapping section TB and the section H, the distance L2 in the axis direction is preferably equal to or greater than 40 mm, more preferably equal to or greater than 70 mm, and still more preferably equal to or greater than 90 mm.

In respect of suppressing the toe down, at least a part of the overlapping section TB preferably exists in a section separated by 40 mm or greater and 200 mm or less from the tip end of the shaft. When the swing weight is maintained, the head weight can be lightened by disposing the overlapping section TB near the hosel, and thereby the toe down can be suppressed.

The overlapping section TB does not exist in the section S. The outer diameter of the shaft of the section S is comparatively small. Therefore, the torsional rigidity in the section S is low. However, since the tip side partial bias layer st and the back end side partial bias layer sb overlap with each other in the overlapping section TB, the torsional rigidity is high. Therefore, the low torsional rigidity in the section S can be complemented by the high torsional rigidity in the overlapping section TB. Therefore, as the whole shaft, the torsion of the shaft during the swing is suppressed. The direction of the face surface during the swing can be stabilized by the constitution, and the direction of the hit ball can be stabilized.

On the other hand, the moderate torsion of the tip part of the shaft at impact is caused by the low torsional rigidity in the section S. The moderate torsion can alleviate shock at impact to provide excellent ball hitting feeling.

In respect of complementing the low torsional rigidity in the section S by the high torsional rigidity in the overlapping section TB, the distribution of the torsional rigidity of the shaft preferably has the local maximum value in the overlapping section TB.

In the embodiment, the overlapping section TB is formed by the overlap of the tip side partial bias layer st and the back end side partial bias layer sb. Therefore, the specifications (the position of the center of gravity G of the shaft, the distribution of the torsional rigidity of the shaft, and the weight of the shaft or the like) of the shaft can be adjusted without thickening the diameter of the tip end of the shaft by the size design of the bias layer st and the bias layer sb. Therefore, a degree of freedom of adjustment of the specifications of the shaft is high.

It is considered that a partial bias reinforcing layer is provided near the hosel instead of providing the overlapping section TB. That is, a constitution in which the partial bias reinforcing layer is disposed in a section corresponding to the overlapping section TB is considered. The partial bias reinforcing layer is provided at the intermediate position in the axis direction of the shaft. Since the partial bias reinforcing layer terminates at both the ends in this case, torsional strength is apt to be reduced at both the ends. Since the bias layer st and the bias layer sb overlaps with each other to form the overlapping section TB in the embodiment, the torsional rigidity is locally enhanced, and the reduction in the torsional strength is suppressed.

As shown in FIG. 2, a back end width of the back end side partial bias layer sb is defined as w1, and a tip width of the back end side partial bias layer sb is defined as w2. The widths w1 and w2 are measured along the circumferential direction of the shaft, and are equal to a width of the sheet before winding. In respect of bringing the center of gravity G of the shaft close to the tip Tp of the sheet, w2/w1 is preferably greater than 1, and more preferably equal to or greater than 1.1. In respect of suppressing excessive torsional rigidity, w2/w1 is preferably equal to or less than 1.3, and more preferably equal to or less than 1.2.

In respect of bringing the center of gravity G of the shaft close to the tip Tp of the sheet, the following constitution (X) is preferable.

(X) A width wb of the back end side partial bias layer sb is increased toward the tip side of the shaft from the back end side of the shaft.

A portion in which the oblique side hp exists is excluded from the measurement of the widths w1, w2, and wb.

Preferably, the oblique side hp is provided as in the embodiment. The oblique side hp is provided in order to disperse the position of the end of the partial layer in the axis direction. The dispersion can alleviate a rapid change of the outer diameter of the shaft and stress concentration. The length of the oblique side hp in the axial direction is preferably 50 mm or greater and 100 mm or less.

In the embodiment of FIGS. 2 and 3, the width wb is constant in the whole range of the axis direction of the shaft. Therefore, in the embodiment, the constitution (X) is not employed. However, in the embodiment of FIGS. 2 and 3, the following constitution (Y) is employed.

(Y) The number Nb of windings of the back end side partial bias layer sb is increased toward the tip side of the shaft from the back end side of the shaft.

The constitution (Y) effectively enhances the torsional rigidity of the whole shaft. Therefore, the directional stability of the hit ball can be improved. A portion in which the oblique side hp exists is excluded from the calculation of the number Nb of windings.

The sheet can be made thin by decreasing a prepreg weight basis amount of the tip side partial bias layer st. The thin sheet decreases the difference of the lamination thickness in the circumferential direction even when the number of windings is a non-integer. Therefore, even when the number of laminations is different by the circumferential position, the uniformity of the circumferential direction can be enhanced. On the other hand, since the back end side outer diameter of the shaft is great, the sheet width tends to be increased. When the sheet width is great, a winding length is increased, which is apt to cause problems such as reduction in working efficiency and displacement of a position of the sheet in the axis direction of the shaft. When the sheet width is excessive, the sheet width may exceed a peripheral length which can be wound by a rolling machine. In this case, the rolling machine cannot be used. The sheet can be thickened by increasing the prepreg weight basis amount of the back end side partial bias layer, and thereby the sheet width can be decreased. The working efficiency is improved by the reduction in the sheet width. From the respect, the back end side partial bias layer sb is preferably thicker than the tip side partial bias layer st.

[Ratio Rs of Straight Layer in Specific Tip Part]

In the present application, a section between the tip Tp of the shaft and a position separated by 80 mm from the tip Tp of the shaft is defined as a specific tip part. In respect of suppressing the toe down, amass ratio Rs of the straight layer in the specific tip part is preferably equal to or greater than 33%, and more preferably equal to or greater than 40%. In respect of preventing the excessive diameter of the tip end of the shaft while providing the tip side partial bias layer st, the ratio Rs is equal to or less than 45%, and more preferably equal to or less than 42%.

The straight layer hardly influence the torsional rigidity. Therefore, even if the ratio Rs is enhanced, the torsional rigidity of the tip part of the shaft does not become excessive. The enhancement of the ratio Rs can suppress the toe down while maintaining the moderate torsional rigidity.

[Shaft Weight Ws]

When the tip side partial bias layer and the back end side partial bias layer are provided, and the overlapping section TB is further provided, the total of the weights of the bias layers is comparatively great. When a shaft weight Ws is great, a head speed is apt to be reduced, while the swing tends to be stabilized. When more importance is placed on the stability of the direction of the hit ball than the flight distance, the shaft weight Ws is preferably rather great. In these respects, the shaft weight Ws is preferably equal to or greater than 70 g, more preferably equal to or greater than 80 g, still more preferably equal to or greater than 90 g, and yet still more preferably equal to or greater than 100 g. In respect of the easiness to swing, the shaft weight Ws is preferably equal to or less than 130 g, and more preferably equal to or less than 120 g.

A preferred shaft includes a full length bias layer pair, a tip side partial bias layer pair, and a back end side partial bias layer pair. The shaft 6 of the embodiment has a full length bias layer pair s23, a tip side partial bias layer pair s45, and a back end side partial bias layer pair s67. Preferably, at least three bias layer pairs are provided. In respect of the weight saving, the number of the bias layer pairs is preferably equal to or less than 5, more preferably equal to or less than 4, and most preferably equal to or less than 3.

The carbon fiber used for the bias layer is not limited, and examples thereof include a pitch-based carbon fiber and a PAN-based carbon fiber. In respect of the torsional strength, the carbon fiber used for the bias layer is preferably the PAN-based carbon fiber. On the other hand, in the pitch-based carbon fiber, high elasticity or low elasticity is possible. In respect of a degree of freedom of a fiber elastic modulus, the pitch-based carbon fiber may be used for the bias layer.

The carbon fiber used for the straight layer is not limited. Examples thereof include the pitch-based carbon fiber and the PAN-based carbon fiber. In respect of flexural strength, the carbon fiber used for the straight layer is preferably the PAN-based carbon fiber. In respect of suppressing stiff ball hitting feeling, the pitch-based carbon fiber having low elasticity (elastic modulus: equal to or less than 15 tf/mm$^2$) may be used for the tip side partial straight layer.

[Shaft Torque]

In respect of suppressing the too rigid hitting feeling, the shaft torque is preferably equal to or greater than 1.0 degree, more preferably equal to or greater than 1.2 degrees, and still more preferably equal to or greater than 1.5 degrees. In respect of the directional stability of the hit ball, the shaft torque is preferably equal to or less than 3.0 degrees, more preferably equal to or less than 2.6 degrees, and still more preferably equal to or less than 2.0 degrees.

A back end of the back end side partial bias layer sb is represented by symbol Pb1 in FIG. 3. Although the back end Pb1 preferably coincides with the back end Bt of the shaft, the back end Pb1 may not coincide with the back end Bt of the shaft. A distance between the back end Pb1 and the back end Bt of the shaft is preferably equal to or less than 100 mm in view of a position grasped by a golf player. In the embodiment of FIG. 3, the back end Pb1 coincides with the back end Bt of the shaft.

A tip of the tip side partial bias layer st is represented by symbol Pt1 in FIG. 3. Although the tip Pt1 preferably coincides with the tip Tp of the shaft, the tip Pt1 may not coincide with the tip Tp of the shaft. A distance between the tip Pt1 and the tip Tp of the shaft is preferably equal to or less than 10 mm in view of the length of the section H. In the embodiment of FIG. 3, the tip Pt1 coincides with the tip Tp of the shaft.

[Club Balance (14-Inch Type)]

When a club balance is appropriately set as described above, the effect of the embodiment can be enhanced. That is, when the club balance is made usual in the embodiment, the head weight can be suppressed. From the theme, the club balance is preferably equal to or greater than C9 as a lower limit, and more preferably equal to or greater than D0. The club balance is preferably equal to or less than D6 as an upper limit, and more preferably equal to or less than D5.

In addition to an epoxy resin, a thermosetting resin other than the epoxy resin and a thermoplastic resin or the like may be also used as the matrix resin of the prepreg sheet. In respect of the shaft strength, the matrix resin is preferably the epoxy resin.

EXAMPLES

Hereinafter, the effects of the present invention will be clarified by examples. However, the present invention should not be interpreted in a limited way based on the description of examples.

Example 1

A shaft having a laminated constitution shown in FIG. 2 was produced. A method for manufacturing the shaft is described above. A shaft full length Ls was set to 940 mm. Prepregs used are shown in the following Table 1. The specifications of example 1 are shown in the following Table 4. An overlapping length L1 was set to 200 mm. A head and a grip were attached to the shaft. The iron number of the head was an approach wedge. A head weight was 298 g, and a club balance was set to D4. The evaluation results of the example 1 are shown in the following Table 5.

Example 2

Although a laminated constitution shown in FIG. 2 was employed in the same manner as in the example 1, an overlapping length L1 was set to 100 mm. A shaft and a club according to example 2 were obtained in the same manner as in the example 1 except for above. Prepregs used in the example 2 are shown in the following Table 1. The specifications of the example 2 are shown in the following Table 4. The evaluation results of the example 2 are shown in the following Table 5.

Example 3

Figure 4:
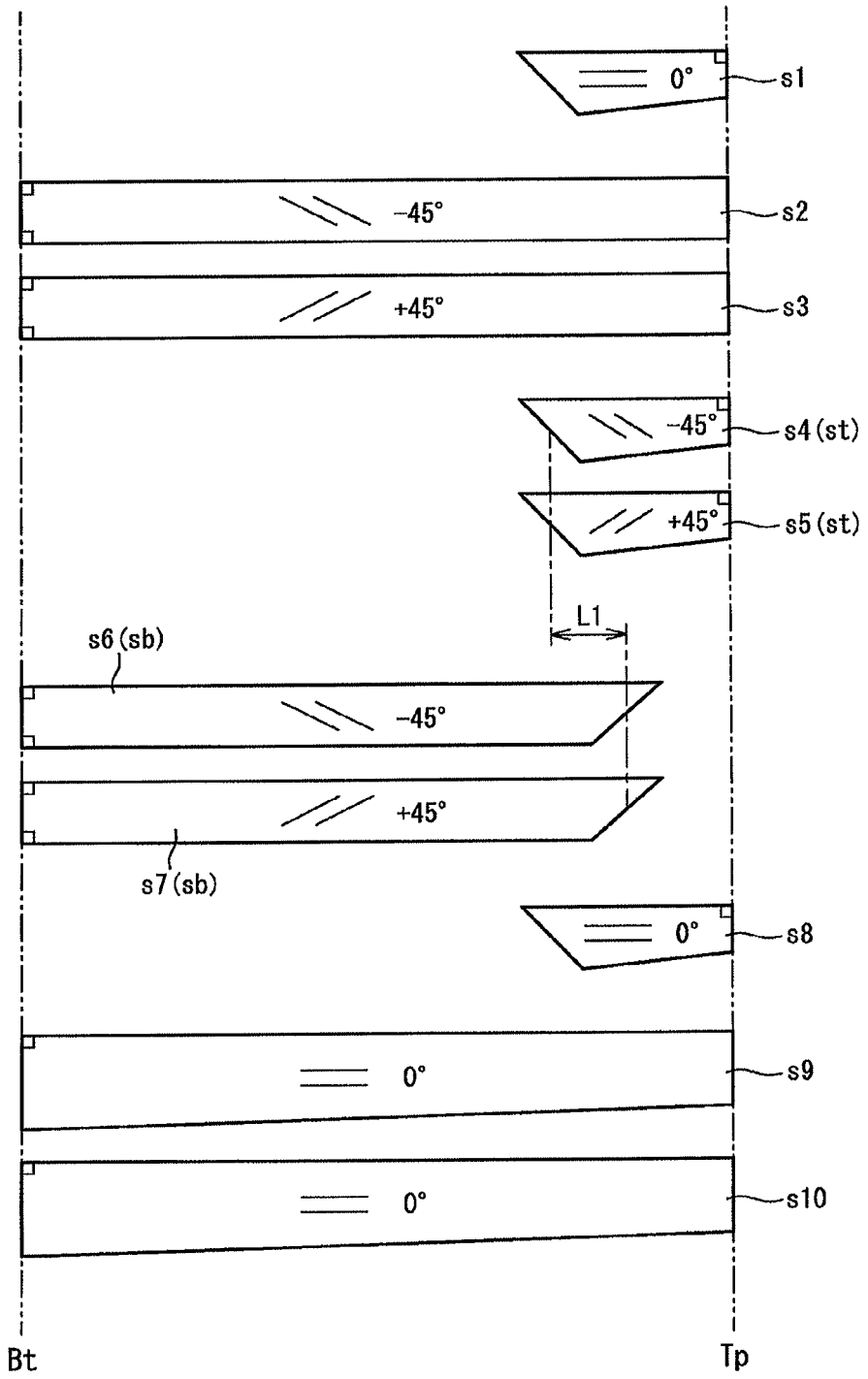
FIG. 4 is a developed view of a shaft of example 3.

FIG. 4 shows a laminated constitution of example 3. As shown in FIG. 4, two tip partial straight sheets were used in the example 3. An overlapping length L1 was set to 200 mm. Prepregs used in the example 3 are shown in the following Table 3. A shaft and a club according to the example 3 were obtained in the same manner as in the example 1 except for above. The specifications of the example 3 are shown in the following Table 4. The evaluation results of the example 3 are shown in the following Table 5.

Comparative Example 1

Figure 5:
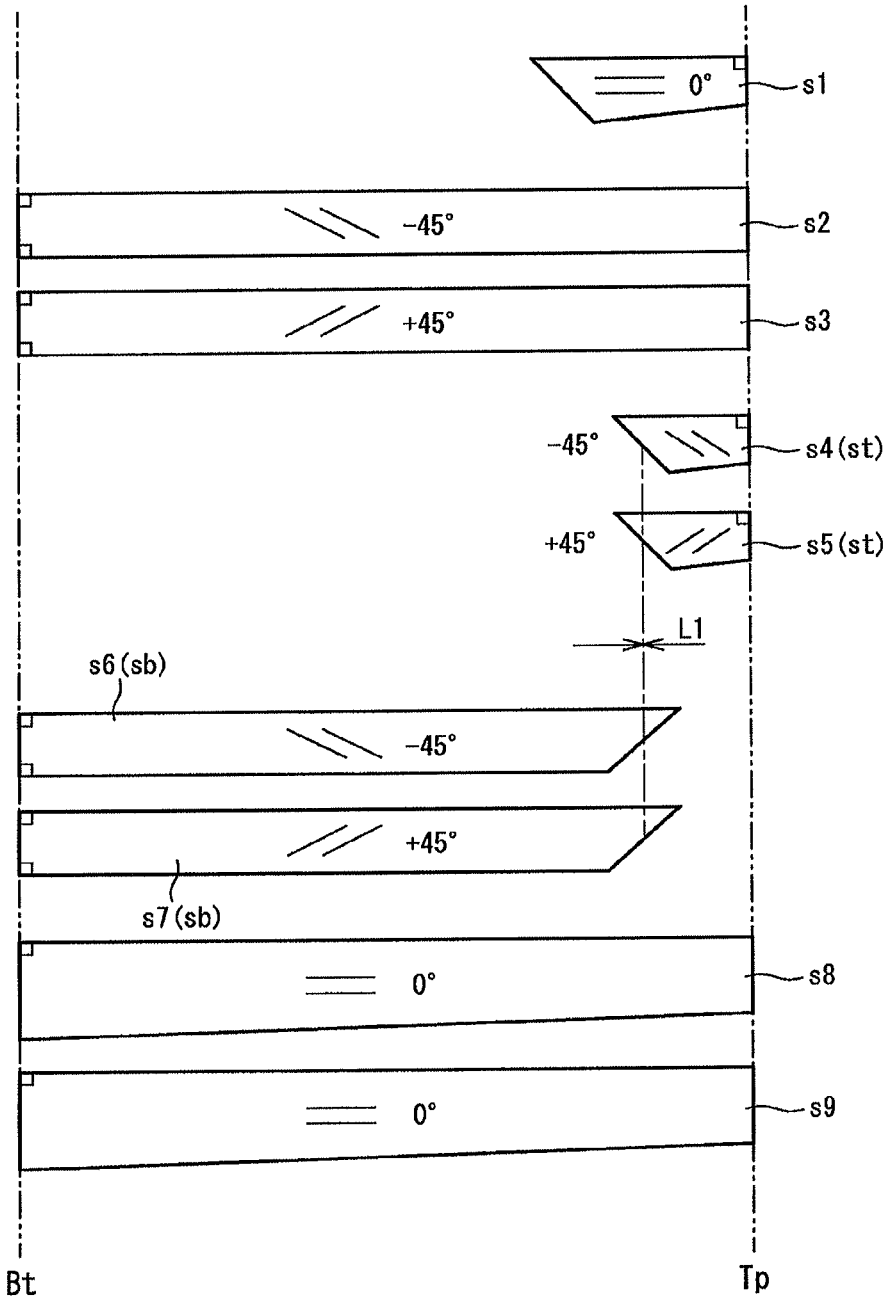
FIG. 5 is a developed view of a shaft of comparative examples 1 and 2.

FIG. 5 shows a laminated constitution of comparative example 1. As shown in FIG. 5, the laminated constitution of the comparative example 1 is the same as that of the example 1 except that an overlapping length L1 is set to 0 mm. In the comparative example 1, the tip position Pb2 is the same as the back end position Pt2. Prepregs used in the comparative example 1 are shown in the following Table 1. A shaft and a club according to the comparative example 1 were obtained in the same manner as in the example 1 except for above. The specifications of the comparative example 1 are shown in the following Table 4. The evaluation results of the comparative example 1 are shown in the following Table 5.

Comparative Example 2

The laminated constitution of FIG. 5 was employed also in comparative example 2. Also in the comparative example 2, an overlapping length L1 is 0 mm. The tip position Pb2 is the same as the back end position Pt2. Prepregs used in the comparative example 2 are shown in the following Table 2. As shown in Table 2, prepregs having a high fiber elastic modulus were employed for a tip side partial bias layer st (layers s4, s5) of the comparative example 2. A shaft and a club according to the comparative example 2 were obtained in the same manner as in the comparative example 1 except for this. The specifications of the comparative example 2 are shown in the following Table 4. The evaluation results of the comparative example 2 are shown in the following Table 5.

The same mandrel was used in all the examples and comparative examples.

In all the examples and comparative examples, a club length and a club balance were set to be constant. A head weight was adjusted so that the club balance becomes constant. The head weights of the examples and comparative examples were as follows.

Example 1: 298 g

Example 2: 299 g

Example 3: 298 g
Comparative Example 1: 300.5 g
Comparative Example 2: 300.5 g
Table 6 shows the specifications of the prepregs.

TABLE 1

| Prepregs used in examples 1 and 2 and comparative example 1 | | |
|---|---|---|
| | Orientation angle Af (degree) | Prepreg product class |
| s1 | 0° | E1026A-14N (Manufactured by Nippon Graphite Fiber (Corporation) |
| s2 | −45° | TR350C-125S (Manufactured by Mitsubishi Rayon Co., Ltd.) |
| s3 | 45° | TR350C-125S (Manufactured by Mitsubishi Rayon Co., Ltd.) |
| s4 | −45° | TR350C-100S (Manufactured by Mitsubishi Rayon Co., Ltd.) |
| s5 | 45° | TR350C-100S (Manufactured by Mitsubishi Rayon Co., Ltd.) |
| s6 | −45° | TR350C-150S (Manufactured by Mitsubishi Rayon Co., Ltd.) |
| s7 | 45° | TR350C-150S (Manufactured by Mitsubishi Rayon Co., Ltd.) |
| s8 | 0° | TR350C-125S (Manufactured by Mitsubishi Rayon Co., Ltd.) |
| s9 | 0° | TR350C-125S (Manufactured by Mitsubishi Rayon Co., Ltd.) |

TABLE 2

| Prepregs used in comparative example 2 | | |
|---|---|---|
| | Orientation angle Af (degree) | Prepreg product class |
| s1 | 0° | E1026A-14N (Manufactured by Nippon Graphite Fiber (Corporation) |
| s2 | −45° | TR350C-125S (Manufactured by Mitsubishi Rayon Co., Ltd.) |
| s3 | 45° | TR350C-125S (Manufactured by Mitsubishi Rayon Co., Ltd.) |
| s4 | −45° | HRX350C-110S (Manufactured by Mitsubishi Rayon Co., Ltd.) |

TABLE 2-continued

| Prepregs used in comparative example 2 | | |
|---|---|---|
| | Orientation angle Af (degree) | Prepreg product class |
| s5 | 45° | HRX350C-110S (Manufactured by Mitsubishi Rayon Co., Ltd.) |
| s6 | −45° | TR350C-150S (Manufactured by Mitsubishi Rayon Co., Ltd.) |
| s7 | 45° | TR350C-150S (Manufactured by Mitsubishi Rayon Co., Ltd.) |
| s8 | 0° | TR350C-125S (Manufactured by Mitsubishi Rayon Co., Ltd.) |
| s9 | 0° | TR350C-125S (Manufactured by Mitsubishi Rayon Co., Ltd.) |

TABLE 3

| Prepregs used in example 3 | | |
|---|---|---|
| | Orientation angle Af (degree) | Prepreg product class |
| s1 | 0° | E1026A-14N (Manufactured by Nippon Graphite Fiber (Corporation) |
| s2 | −45° | TR350C-125S (Manufactured by Mitsubishi Rayon Co., Ltd.) |
| s3 | 45° | TR350C-125S (Manufactured by Mitsubishi Rayon Co., Ltd.) |
| s4 | −45° | TR350C-100S (Manufactured by Mitsubishi Rayon Co., Ltd.) |
| s5 | 45° | TR350C-100S (Manufactured by Mitsubishi Rayon Co., Ltd.) |
| s6 | −45° | TR350C-150S (Manufactured by Mitsubishi Rayon Co., Ltd.) |
| s7 | 45° | TR350C-150S (Manufactured by Mitsubishi Rayon Co., Ltd.) |
| s8 | 0° | TR350C-100S (Manufactured by Mitsubishi Rayon Co., Ltd.) |
| s9 | 0° | TR350C-125S (Manufactured by Mitsubishi Rayon Co., Ltd.) |
| s10 | 0° | TR350C-125S (Manufactured by Mitsubishi Rayon Co., Ltd.) |

TABLE 4

| Specifications of examples and comparative examples | | | | | |
|---|---|---|---|---|---|
| | Examples 1 | Examples 2 | Example 3 | Comparative example 1 | Comparative example 2 |
| Overlapping length L1 | 200 mm | 100 mm | 200 mm | 0 mm | 0 mm |
| Distance L2 | 135 mm | 135 mm | 135 mm | 135 mm | 135 mm |
| Straight layer ratio in whole shaft (wt %) | 30% | 30% | 33% | 30% | 30% |
| Shaft weight | 115 g | 115 g | 115 g | 115 g | 115 g |
| Position Lg of center of gravity | 475 mm | 480 mm | 475 mm | 487 mm | 487 mm |
| Forward flex | 48 mm | 48 mm | 48 mm | 47 mm | 47 mm |
| Backward flex | 24 mm | 25 mm | 21 mm | 26 mm | 26 mm |
| Torque | 1.5 deg | 1.5 deg | 1.7 deg | 1.7 deg | 1.5 deg |
| Diameter of tip of shaft | 9.02 mm | 9.02 mm | 9.02 mm | 9.02 mm | 9.02 mm |
| Ratio Rs of straight layer in specific tip part (wt %) | 34% | 34% | 41% | 34% | 34% |

TABLE 5

| Evaluation results of examples and comparative examples | | | | | | |
|---|---|---|---|---|---|---|
| Evaluation item | Tester | Examples 1 | Examples 2 | Examples 3 | Comparative example 1 | Comparative example 2 |
| Directional stability | A | 4 | 4 | 4 | 4 | 4 |
| | B | 5 | 4 | 5 | 4 | 4 |
| | C | 4 | 4 | 4 | 3 | 4 |
| | D | 4 | 4 | 4 | 4 | 4 |
| | E | 4 | 4 | 4 | 3 | 3 |
| | Average | 4.2 | 4 | 4.2 | 3.6 | 3.8 |
| Flight distance stability | A | 4 | 3 | 4 | 3 | 3 |
| | B | 3 | 3 | 4 | 3 | 3 |
| | C | 4 | 4 | 5 | 3 | 4 |
| | D | 4 | 4 | 5 | 4 | 4 |
| | E | 4 | 4 | 5 | 4 | 4 |
| | Average | 3.8 | 3.6 | 4.6 | 3.4 | 3.6 |
| Feeling | A | 4 | 3 | 4 | 4 | 3 |
| | B | 5 | 4 | 3 | 4 | 3 |
| | C | 3 | 3 | 3 | 3 | 3 |
| | D | 4 | 4 | 5 | 3 | 3 |
| | E | 4 | 4 | 4 | 4 | 4 |
| | Average | 4 | 3.6 | 3.8 | 3.6 | 3.2 |
| Score | 5 | 4 | 3 | 2 | 1 | |
| Content | Very good | Good | Average | Poor | Very poor | |

TABLE 6

| Specifications of prepregs | | | | | | | | | |
|---|---|---|---|---|---|---|---|---|---|
| | | | | Prepreg | | | Physical property value of carbon fiber | | |
| Manufacturer | Part number | Thickness of sheet (mm) | Kind of carbon fiber | weight basis amount ($g/m^2$) | Fiber content (wt %) | Resin content (wt %) | Part number of carbon fiber | Tensile elastic modulus ($tonf/mm^2$) | Tensile strength ($kgf/mm^2$) |
| Nippon Graphite Fiber Corporation | E1026A-14N | 0.153 | Pitch-based | 151 | 63 | 37 | XN-10 | 10 | 170 |
| Mitsubishi Rayon Co., Ltd. | TR350C-100S | 0.083 | PAN-based | 133 | 75 | 25 | TR50S | 24 | 500 |
| Mitsubishi Rayon Co., Ltd. | TR350C-125S | 0.104 | PAN-based | 167 | 75 | 25 | TR50S | 24 | 500 |
| Mitsubishi Rayon Co., Ltd. | TR350C-150S | 0.124 | PAN-based | 200 | 75 | 25 | TR50S | 24 | 500 |
| Mitsubishi Rayon Co., Ltd. | MR350C-075S | 0.063 | PAN-based | 100 | 75 | 25 | MR40 | 30 | 450 |
| Mitsubishi Rayon Co., Ltd. | MR350C-100S | 0.085 | PAN-based | 133 | 75 | 25 | MR40 | 30 | 450 |
| Mitsubishi Rayon Co., Ltd. | MR350C-125S | 0.105 | PAN-based | 167 | 75 | 25 | MR40 | 30 | 450 |
| Mitsubishi Rayon Co., Ltd. | HRX350C-075S | 0.057 | PAN-based | 92 | 75 | 25 | HR40 | 40 | 450 |
| Mitsubishi Rayon Co., Ltd. | HRX350C-110S | 0.082 | PAN-based | 132 | 75 | 25 | HR40 | 40 | 450 |

Note)
A tensile strength and a tensile elastic modulus are values measured in accordance with JIS R7601:1986 "Testing Method for Carbon Fibers".

[Valuation Methods]

Valuation methods are as follows.

[Club Balance (Swing Weight)]

A 14-inch type club balance was measured by using "BANGER-14" (trade name) manufactured by DAININ Corporation.

[Torque]

A portion between a tip Tp of a shaft and a position separated by 40 mm from the tip Tp was nonrotatably fixed by a tip jig, and a portion located on the back end side of the shaft and having an axial length of 50 mm was grasped by a back end jig capable of applying a torque. A torque Tr of 13.9 kgf·cm was allowed to act on the back end jig. A torsion angle (degree) of the shaft at the torque action position was defined as a shaft torque. An axial length between the back end jig and the tip jig was set to 825 mm. When the shaft was deformed by the grasping of the tip jig or the back end jig, the shaft torque was measured with a core material or the like put in the shaft. The measured values are shown in Table 4.

[Forward Flex]

Figure 6A:
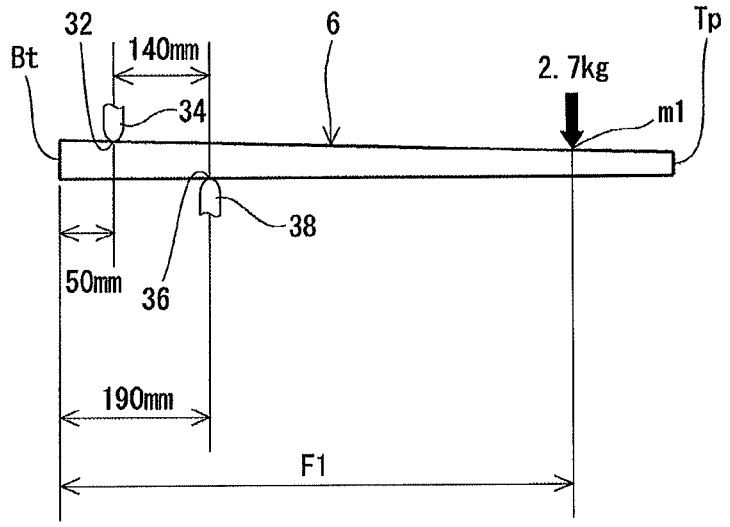
FIG. 6A shows a method for measuring a forward flex.

FIG. 6A shows a method for measuring a forward flex. As shown in FIG. 6A, a first supporting point 32 is set at a position separated by 50 mm from a back end Bt. Furthermore, a second supporting point 36 is set at a position separated by 190 mm from the back end Bt. A support 34 supporting the shaft 6 from above is provided at the first supporting point 32. A support 38 supporting the shaft 6 from the underside is provided at the second supporting point 36. In a state where no load is applied, the shaft axial line of the shaft 6 is substantially horizontal. At a load point m1 separated by F1 mm from the back end Bt, a load of 2.7 kg is allowed to act in a vertical downward direction. The distance F1 was set to 875 mm. A travel distance (mm) of the load point m1 between the state where no load is applied and a state where a load is applied is the forward flex. The travel distance is a travel distance along the vertical direction.

The section shape of a portion (hereinafter, referred to as an abutting portion) of the support 34 abutting on the shaft is as follows. The section shape of the abutting portion of the support 34 has convex roundness in a section parallel to an axis direction of the shaft. The curvature radius of the roundness is 15 mm. The section shape of the abutting portion of the support 34 has concave roundness in a section perpendicular to the axis direction of the shaft. The curvature radius of the concave roundness is 40 mm. The horizontal length (a length in a depth direction in FIG. 6A) of the abutting portion of the support 34 is 15 mm in the section perpendicular to the axis direction of the shaft. The section shape of the abutting portion of the support 38 is the same as that of the support 34. The section shape of the abutting portion of a load indenter (not shown) applying a load of 2.7 kg in the load point m1 has convex roundness in the section parallel to the axis direction of the shaft. The curvature radius of the roundness is 10 mm. The section shape of the abutting portion of a load indenter (not shown) applying a load of 2.7 kg in the load point m1 is a straight line in the section perpendicular to the axis direction of the shaft. The length of the straight line is 18 mm.

[Backward Flex]

Figure 6B:
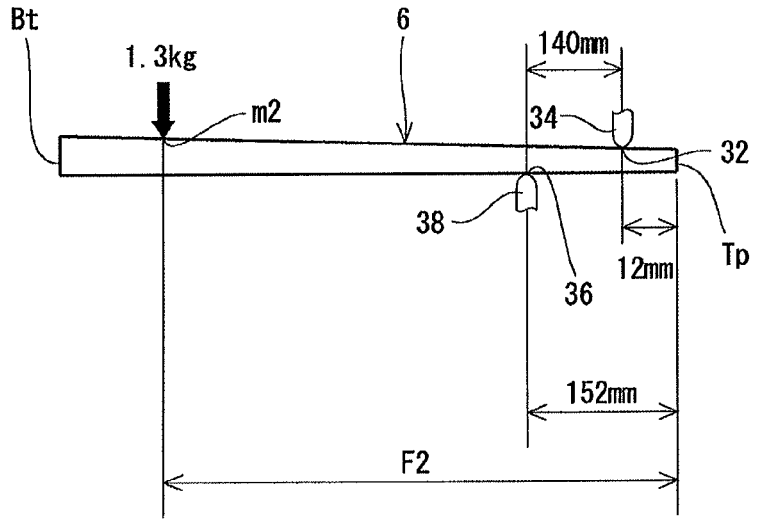
FIG. 6B shows a method for measuring a backward flex.

A method for measuring a backward flex is shown in FIG. 6B. The backward flex was measured in the same manner as in the forward flex except that the first supporting point 32 was set to a point separated by 12 mm from a tip Tp; the second supporting point 36 was set to a point separated by 152 mm from the tip Tp; a load point m2 was set to a point separated by F2 mm from the tip Tp; and a load was set to 1.3 kg. The distance F2 was set to 748 mm.

[Torsional Rigidity Value GI]

Figure 7:
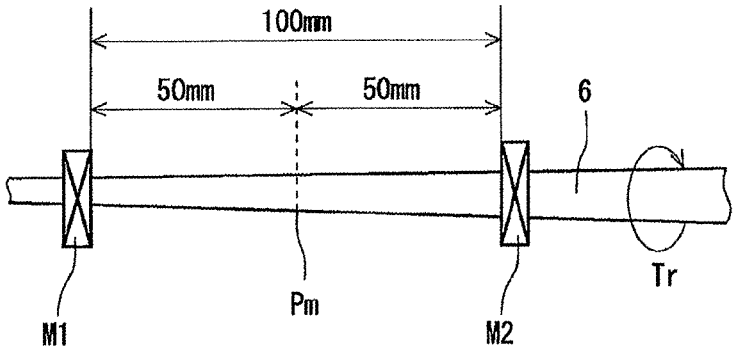
FIG. 7 shows a method for measuring a torsional rigidity value GI.

FIG. 7 shows a method for measuring a torsional rigidity value GI at a point Pm. A first position was fixed by a jig M1, and a second position separated by 100 mm from the jig M1 was held by a jig M2. The point Pm is an intermediate point between the first position and the second position. A torsion angle A (degree) of the shaft 6 when a torque Tr of 1.363 (N·m) was applied to the jig M2 was measured. The torsional rigidity value GI was calculated by the following formula.

$$GI(\mathrm{N{\cdot}m^2})=M\times Tr/A$$

M is a measuring span (m); Tr is a torque (N·m); and A is a torsion angle (rad). The measuring span M is 0.1 m, and the torque Tr is 1.363 (N·m).

Figure 8:
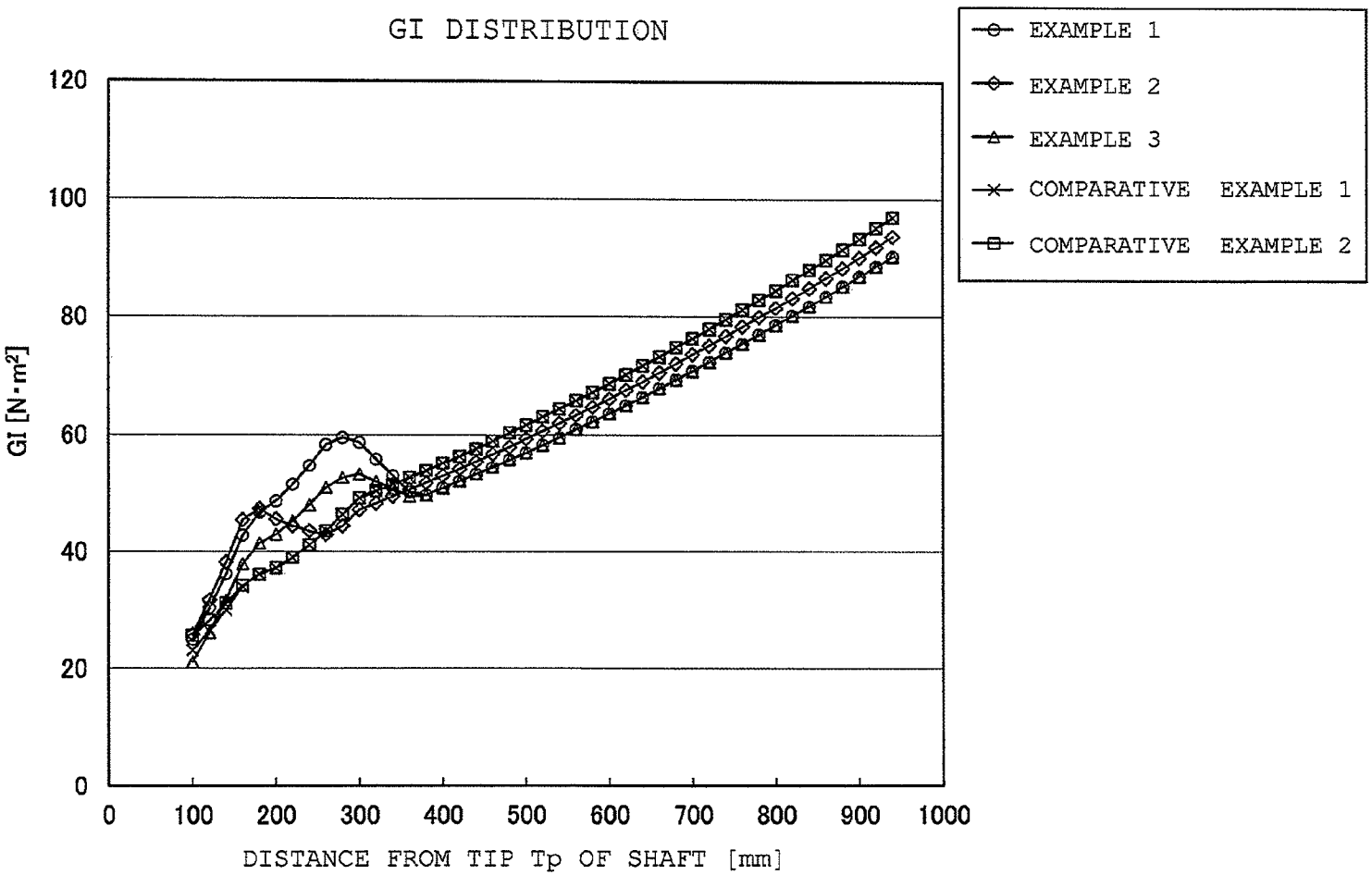
FIG. 8 is a graph showing distributions of the torsional rigidity values GI in examples and comparative examples.

FIG. 8 is a graph showing the distributions of the measured torsional rigidity values GI. In all the examples, the local maximum value exists in the overlapping section TB.

[Directional Stability]

Sensuous evaluation was conducted by five testers (testers A, B, C, D, and E). The directional stability of the hit ball was evaluated at five stages of a one score to a five score. The higher the score is, the better the directional stability is. The average values of the evaluation scores of the five testers are shown in Table 5.

[Flight Distance Stability]

Sensuous evaluation was conducted by the five testers.

Flight distance stability was evaluated at five stages of a one score to a five score. The higher the score is, the smaller the variation of the flight distance is. The average values of the evaluation scores of the five testers are shown in Table 5.

[Feeling]

Sensuous evaluation was conducted by the five testers. Feeling (ball hitting feeling) was evaluated at five stages of a one score to a five score. The higher the score is, the better the feeling is. The average values of the evaluation scores of the five testers are shown in Table 5.

The evaluations of the examples are higher than those of the comparative examples. In the examples, the flight distance stability of the example 3 is particularly high. The tip straight layer ratio Rs of the example 3 is high. For this reason, toe down was suppressed, and the probability for a nice shot was improved.

The advantages of the present invention are apparent from these results.

The present invention can be applied to all golf clubs.

The description hereinabove is merely for an illustrative example, and various modifications can be made in the scope not to depart from the principles of the present invention.

What is claimed is:

1. A golf club shaft comprising:

a straight layer continuous along an entire length of the shaft;

a tip side partial bias layer wherein the tip side partial bias layer does not extend to a back end of the shaft and does extend to a tip end of the shaft;

a back end side partial bias layer wherein the back end side partial bias layer does not extend to a tip end of the shaft and does extend to a back end of the shaft, wherein when a section where the tip side partial bias layer exists in an axis direction of the shaft is defined as a section T;

a section where the back end side partial bias layer exists in the axis direction of the shaft is defined as a section B;

a shaft section inserted into a hosel of ahead in the axis direction of the shaft is defined as a section H, a part of the section T overlaps with the section H;

an overlapping section TB in which the section T overlaps with the section B exists;

the whole overlapping section TB is located on a back end side of the shaft from the section H;

a center position Px in the axis direction of the overlapping section TB is located on a tip side of the shaft from a center position Pc of the shaft in the axis direction of the shaft; and wherein the absolute angle of the fibers of the tip side partial bias layer and the back end side partial layer is equal to or greater than 15 degrees and equal to or less than 60 degrees with the axis direction of the shaft.

2. The golf club shaft according to claim 1, wherein at least a part of the overlapping section TB exists in a section separated by 40 mm or greater and 200 mm or less from a tip end of the shaft.

3. The golf club shaft according to claim 1, wherein a tip of the back end side partial bias layer is located in a section separated by 40 mm or greater and 190 mm or less from a tip end of the shaft.

4. The golf club shaft according to claim 1, wherein a torsional rigidity distribution has a local maximum value in the overlapping section TB.

5. The golf club shaft according to claim 1, wherein when a back end width of the back end side partial bias layer is defined as w1, and a tip width of the back end side partial bias layer is defined as w2, w2/w1 is greater than 1.

6. The golf club shaft according to claim 5, wherein w2/w1 is 1.1 or greater and 1.3 or less.

7. The golf club shaft according to claim 1, wherein a width wb of the back end side partial bias layer is increased toward the tip side of the shaft from the back end side of the shaft.

8. The golf club shaft according to claim 1, wherein a prepreg weight basis amount of the tip side partial bias layer is less than that of the back end side partial bias layer.

9. The golf club shaft according to claim 1, wherein when a section between a tip end of the shaft and a position separated by 80 mm from the tip end of the shaft is defined as a specific tip part, a mass ratio Rs of the straight layer in the specific tip part is 33% or greater and 45% or less.

10. The golf club shaft according to claim 9, wherein the ratio Rs is 40% or greater and 42% or less.

11. The golf club shaft according to claim 1, wherein the tip side partial bias layer and the back end side partial bias layer are brought into contact with each other in the overlapping section TB.

12. The golf club shaft according to claim 1, wherein an axial length L1 of the overlapping section TB is 50 mm or greater and 300 mm or less.

13. The golf club shaft according to claim 1, wherein when a shaft full length is defined as Ls, and a distance between a tip end of the shaft and a center of gravity of the shaft is defined as Lg, Lg/Ls is equal to or less than 0.515.

14. The golf club shaft according to claim 13, wherein Lg/Ls is equal to or greater than 0.48.

15. The golf club shaft according to claim 1, wherein a shaft full length Ls is 33 inches or greater and 37 inches or less.

16. The golf club shaft according to claim 1, wherein the number Nb of windings of the back end side partial bias layer is increased toward the tip side of the shaft from the back end side of the shaft.

17. The golf club shaft according to claim 1, wherein the back end side partial bias layer is thicker than the tip side partial bias layer.

18. The golf club shaft according to claim 1, wherein a shaft weight is 70 g or greater and 130 g or less.

19. The golf club shaft according to claim 1, wherein a shaft torque is 1.0 degree or greater and 3.0 degrees or less.

20. A golf club comprising a shaft according to claim 1, a head, and a grip.

* * * * *